US007918199B2

(12) United States Patent
Hashimoto et al.

(10) Patent No.: US 7,918,199 B2
(45) Date of Patent: Apr. 5, 2011

(54) V-TYPE ENGINE

(75) Inventors: Manabu Hashimoto, Saitama (JP); Keita Ito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 421 days.

(21) Appl. No.: 12/109,044

(22) Filed: Apr. 24, 2008

(65) Prior Publication Data

US 2008/0264361 A1 Oct. 30, 2008

(30) Foreign Application Priority Data

Apr. 27, 2007 (JP) ..... 2007-120058

(51) Int. Cl.
*F01L 1/02* (2006.01)
*F02B 75/22* (2006.01)

(52) U.S. Cl. ..... 123/90.31; 123/54.4; 123/90.39; 123/90.4; 123/94.41; 123/90.44

(58) Field of Classification Search ..... 123/90.31, 123/90.39, 90.4, 90.41, 90.44–90.47, 54.4, 123/56.8, 188.1, 188.14, 188.16, 321, 198 F, 123/90.6
See application file for complete search history.

(56) References Cited

U.S. PATENT DOCUMENTS 1,524,150 A * 1/1925 Rhoads ..... 123/90.38
2,769,434 A * 11/1956 Witzky ..... 123/54.7
5,253,621 A 10/1993 Dopson et al.
6,755,168 B2 * 6/2004 Schneider et al. ..... 123/182.1
2002/0026918 A1 3/2002 Durr et al.
2002/0078915 A1 * 6/2002 Schneider et al. ..... 123/182.1
2004/0094110 A1 * 5/2004 Burger et al. ..... 123/182.1
2005/0034698 A1 2/2005 Matsuda et al.
2005/0061281 A1 3/2005 Klotz
2008/0156283 A1 * 7/2008 Hasebe et al. ..... 123/54.4

FOREIGN PATENT DOCUMENTS

EP 0 637 682 A1 2/1995
EP 1 318 277 A2 6/2003
JP 3-107515 A 5/1991

* cited by examiner

*Primary Examiner* — Michael Cuff
*Assistant Examiner* — Hung Q Nguyen
(74) *Attorney, Agent, or Firm* — Arent Fox LLP

(57) ABSTRACT

In a V-type engine, intake and exhaust rocker arms in each bank are arranged in a substantially inverted-V-shape in a plan view, so that side end portions of corresponding intake and exhaust push rods are positioned adjacent to each other. Slipper portions of first and second intake cam followers have end portions at one end along the axial direction of a camshaft protrude respectively in opposite directions to each other so that they face each other across an intake cam therebetween. Slipper portions of first and second exhaust cam followers have end portions at one end along the axial direction of the camshaft protrude respectively in opposite directions to each other so that they face each other across an exhaust cam therebetween. This reduces the distance between the push rods in each bank to provide a compact valve-operating device.

3 Claims, 15 Drawing Sheets

V-TYPE ENGINE

BACKGROUND OF THE INVENTION

1. Field of the Invention

The present invention relates to a V-type engine comprising: first and second banks each of which includes a cylinder bore therein, and which are arranged in a V-shape so as to define a valley portion therebetween; a crankcase with which the first and second banks are continuously formed; a crankshaft supported by the crankcase; a cooling fin which protrudes on an outer wall of each of the banks; intake and exhaust valves which are arranged in a V-shape in a head portion of each of the banks; and a valve-operating device which drives the intake and exhaust valves to be opened and closed, the valve-operating device including: a camshaft being disposed above the crankshaft and driven by the crankshaft, first intake and exhaust cam followers and second intake and exhaust cam followers being moved up and down by intake and exhaust cams of the camshaft, respectively, first intake and exhaust push rods and second intake and exhaust push rods, the first intake and exhaust push rods having lower ends which are operatively connected respectively to the first intake and exhaust cam followers, and being disposed on the valley portion side of the first bank, the second intake and exhaust push rods having lower ends which are operatively connected respectively to the second intake and exhaust cam followers, and being disposed on the valley portion side of the second bank, and first intake and exhaust rocker arms and second intake and exhaust rocker arms, the first intake and exhaust rocker arms operatively connecting upper ends of the first intake and exhaust push rods respectively to the intake and exhaust valves of the first bank, the second intake and exhaust rocker arms operatively connecting upper ends of the seconds intake and exhaust push rods respectively to the intake and exhaust valves of the second bank.

2. Description of the Related Art

Such a V-type engine is already known as disclosed in, for example, Japanese Patent Application Laid-open No. 3-107515.

In the conventional V-type engine, the distance between intake and exhaust push rods in each bank is increased in association with the V-shape arrangement of intake and exhaust valves in each bank, thus resulting in a difficulty of achieving a more compact valve-operating device.

SUMMARY OF THE INVENTION

The present invention has been made in view of the above-described circumstances. An object of the present invention is to provide a V-type engine having the following characteristics. Specifically, the V-type engine has a compact valve-operating device achieved by a sufficiently reduced distance between intake and exhaust push rods in each of banks. In addition, in the V-type engine, sliding contact portions of intake and exhaust cam followers with corresponding intake and exhaust cams are sufficiently increased, so that the surface pressure of their sliding contact portions is reduced. As a result, the durability of the sliding contact portions can be improved.

In order to achieve the object, according to a first feature of the present invention, there is provided a V-type engine comprising: first and second banks each of which includes a cylinder bore therein, and which are arranged in a V-shape so as to define a valley portion therebetween; a crankcase with which the first and second banks are continuously formed; a crankshaft supported by the crankcase; a cooling fin which protrudes on an outer wall of each of the banks; intake and exhaust valves which are arranged in a V-shape in a head portion of each of the banks; and a valve-operating device which drives the intake and exhaust valves to be opened and closed, the valve-operating device including: a camshaft being disposed above the crankshaft and driven by the crankshaft, first intake and exhaust cam followers and second intake and exhaust cam followers being moved up and down by intake and exhaust cams of the camshaft, respectively, first intake and exhaust push rods and second intake and exhaust push rods, the first intake and exhaust push rods having lower ends which are operatively connected respectively to the first intake and exhaust cam followers, and being disposed on the valley portion side of the first bank, the second intake and exhaust push rods having lower ends which are operatively connected respectively to the second intake and exhaust cam followers, and being disposed on the valley portion side of the second bank, and first intake and exhaust rocker arms and second intake and exhaust rocker arms, the first intake and exhaust rocker arms operatively connecting upper ends of the first intake and exhaust push rods respectively to the intake and exhaust valves of the first bank, the second intake and exhaust rocker arms operatively connecting upper ends of the second intake and exhaust push rods respectively to the intake and exhaust valves of the second bank, wherein the intake and exhaust rocker arms in each bank are arranged in a substantially inverted-V-shape in a plan view, so that end portions of the intake and exhaust rocker arms on the side of the corresponding intake and exhaust push rods are positioned adjacent to each other, thereby intake and exhaust push rods are positioned adjacent to each other, each of the cam followers is comprised of a boss portion swingably supported on a single cam follower shaft supported by the crankcase at a position directly above and in parallel with the camshaft, and a slipper portion being in sliding contact with a corresponding one of the intake and exhaust cams, the boss portions of the first and second intake cam followers abut against each other side by side on the cam follower shaft, while their slipper portions have end portions at one end along an axial direction of the camshaft protrude respectively in opposite directions to each other in such a manner that the slipper portions face each other across the intake cam located therebetween, the boss portions of the first and second exhaust cam followers abut against each other side by side on the cam follower shaft, while their slipper portions have end portions at one end along the axial direction of the camshaft protrude respectively in opposite directions to each other in such a manner that the slipper portions face each other across the exhaust cam located therebetween, the first and second intake cam followers and the first and second exhaust cam followers are arranged adjacent to one another on an intermediate portion of the cam follower shaft, which is supported, at opposite end portions thereof, by the crankcase, and corresponding to the cam followers, the intake and exhaust cams are arranged adjacent to each other.

With the first feature of the present invention, the intake and exhaust rocker arms in each bank are arranged in a substantially inverted-V-shape in the plan view, so that the end portions of the intake and exhaust rocker arms on the side of the corresponding intake and exhaust push rods are positioned adjacent to each other. Since the intake and exhaust push rods are positioned adjacent to each other, the first and second intake cam followers and the first and second exhaust cam followers can be arranged adjacent to one another on the intermediate portion of a single cam follower shaft. Further, in conjunction with the arrangement of the cam followers, the intake and exhaust cams can be arranged adjacent to each other. As a result, it is possible to achieve a compact valve-operating device, and eventually a compact V-type engine.

Moreover, in the first and second intake cam followers, their boss portions abut against each other side by side on the cam follower shaft, while their slipper portions have end portions at one end along the axial direction of the camshaft protrude respectively in opposite directions to each other in such a manner that the slipper portions face each other across the intake cam located therebetween. In addition, in the first and second exhaust cam followers, their boss portions abut against each other side by side on the cam follower shaft, while their slipper portions have end portions at one end along the axial direction of the camshaft protrude respectively in opposite directions to each other in such a manner that the slipper portions face each other across the exhaust cam located therebetween. Accordingly, the intake and exhaust cam, and the first intake and exhaust cam followers as well as the second intake and exhaust cam followers can be concentratedly arranged on the single camshaft and the single cam follower shaft. This makes it possible to achieve the compact valve-operating device, and in particular, to shorten the camshaft. Furthermore, the following effect is provided by the structure in which, in each of the pair of the first and second intake cam followers as well as the pair of the first and second exhaust cam followers, the slipper portions, which are positioned respectively on the opposite sides of the corresponding cam, have the end portions at one end along the axial direction of the camshaft protrude respectively in opposite directions to each other in such a manner that the slipper portions face each other across. Specifically, it is possible to sufficiently secure the sliding contact portions of the intake and exhaust cam followers with the intake and exhaust cams without interfering with the reduction in size of the valve-operating device. As a result, the surface pressure of each of the sliding contact portions is sufficiently reduced, so that the durability of the sliding contact portions can be improved.

According to a second feature of the present invention, in addition to the first feature, the first and second intake and exhaust cam followers of both of the banks as well as the intake and exhaust cams are mostly placed within a space between planes extended respectively from opposite end surfaces of a crankpin of the crankshaft.

With the second feature of the present invention, it is possible to achieve a further compact valve-operating device, and also to effectively lubricate the periphery of the intake and exhaust cams with lubricating oil dispersed from around the crankpin during the crankshaft rotation.

According to a third feature of the present invention, in addition to any one of the first or second feature, the V-type engine further comprises: a flat portion formed in the camshaft so as to extend from an outer peripheral face of the camshaft to a base surface of the exhaust cam; a decompressing member being swingably and pivotally supported on the flat portion, and including a decompressing arm which is located over a period between instants when the V-type engine stops and starts, to its operating position on the base surface side of the exhaust cam and protrudes its tip end from the base surface so as to lift the first and second exhaust cam followers in the compression stroke of the V-type engine, and a centrifugal weight which generates a centrifugal force for retreating the decompressing arm from the base surface when the V-type engine is operated at a rotational speed higher than that during the idling of the V-type engine; and a return spring for urging the decompressing arm toward the operating position, the return spring being connected to the decompressing member.

With the third feature of the present invention, it is possible to provide the following effect in association with the structure of the first and second exhaust cam followers in which their boss portions abut against each other side by side on the cam follower shaft, and in which their slipper portions have end portions at one end along the axial direction of the camshaft protrude respectively in opposite directions to each other in such a manner that the slipper portions face each other across the exhaust cam located therebetween. Specifically, at the operating position of the decompressing member, only slight protrusion of a tip end portion of the decompressing arm toward the exhaust cam makes it possible to provide very slight lift to the first and second exhaust cam followers by bringing the tip end portion substantially evenly in sliding contact with the first and second exhaust cam followers. In this regard, since the tip end portion of the decompressing arm protrudes by only a small length toward the exhaust cam, it is possible to achieve a compact single decompressing device shared by both the banks, and also to improve the durability of the exhaust cam and the exhaust cam followers while minimizing a reduction in the effective area of the base surface of the exhaust cam due to the formation of the flat portion.

Furthermore, the flat portion is formed on the camshaft so as to extend from the general surface of the camshaft to the base surface of the exhaust cam, while the decompressing arm of the decompressing member, which is supported around an axis on the flat portion, is caused to protrude toward the base surface of the exhaust cam when the V-type engine is stopped or started. This structure eliminates the need to cause the slipper portions of the exhaust cam followers to protrude outward of the exhaust cam. As a result, it is possible to achieve the decompressing operation performed at the time of start of the V-type engine while maintaining the compactness of the valve-operating device.

The above-mentioned object, other objects, characteristics, and advantages of the present invention will become apparent from an explanation of a preferred embodiment, which will be described in detail below by reference to the attached drawings.

DESCRIPTION OF THE PREFERRED EMBODIMENTS

An embodiment of the present invention will be described below with reference to the accompanying drawings.

Figure 1:
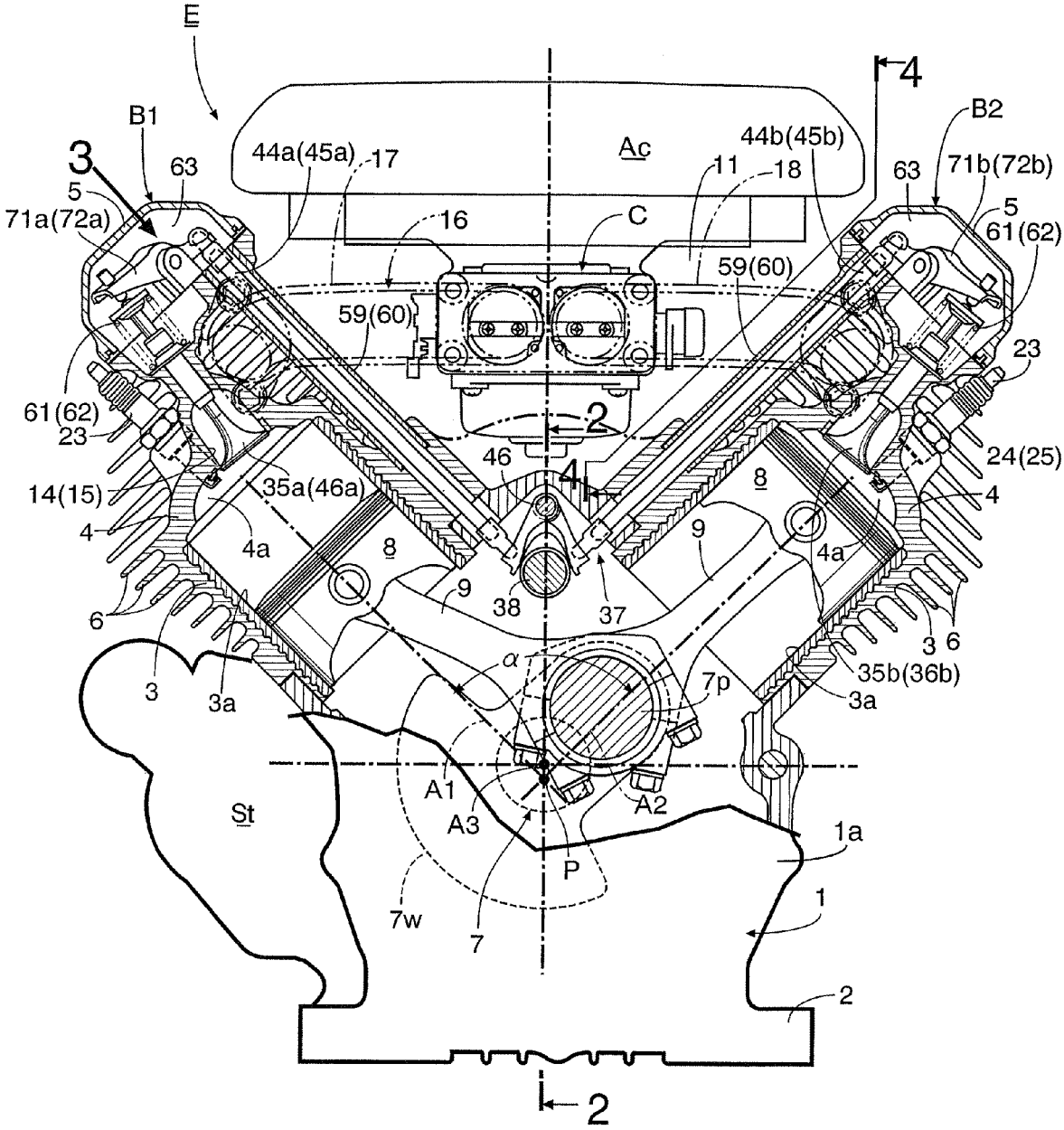
FIG. 1 is a vertical sectional front view of an air-cooled general-purpose V-type engine according to the present invention.
Figure 2:
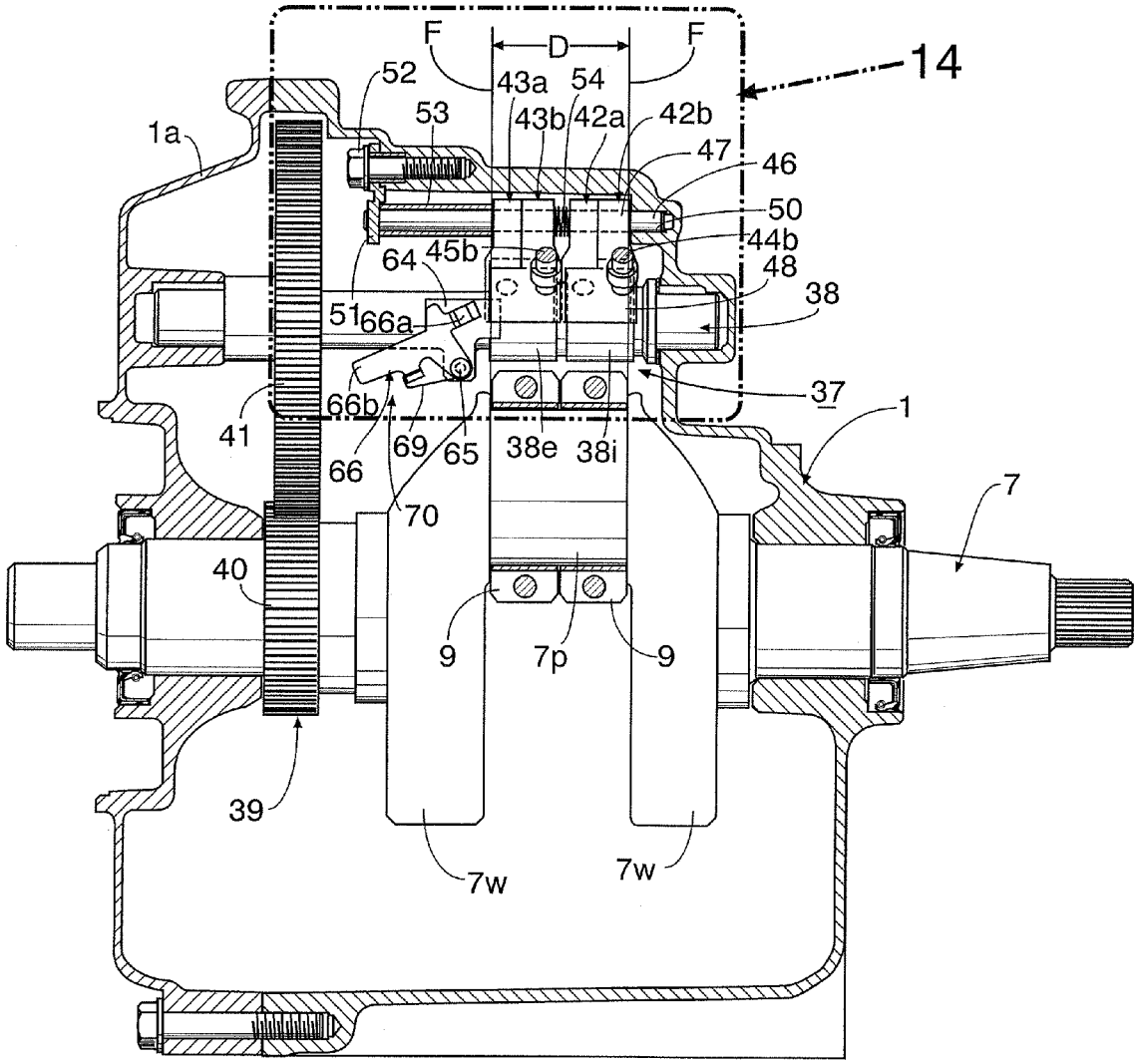
FIG. 2 is a sectional view taken along the line 2-2 in FIG. 1.
Figure 3:
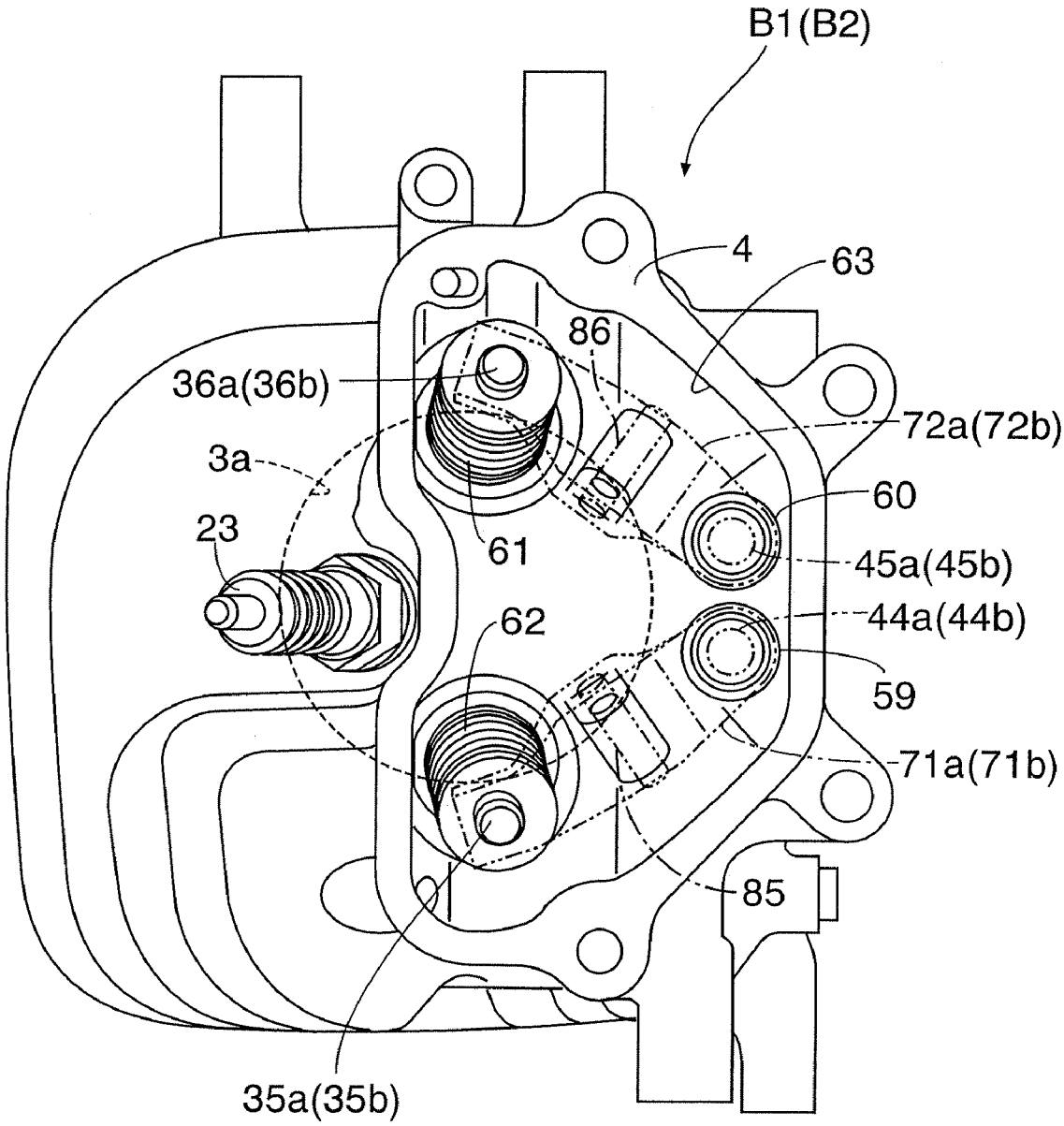
FIG. 3 is a view in the direction of the arrow 3 in FIG. 1.

Firstly, as shown in FIGS. 1 to 3, the air-cooled general-purpose V-type engine includes: a crankcase 1; a first bank B1 and a second bank B2 which are arranged respectively on the left and right sides in a V-shape, and which are connected to an upper portion of the crankcase 1; an installation flange 2 formed in a bottom portion of the crankcase 1; and a starter device St provided in one side portion of the crankcase so as to be housed in a space below the first bank B1.

Each of the first and second banks B1 and B2 includes: a cylinder block 3 which has a cylinder bore 3*a*, and which is bolt-coupled to the crankcase 1; a cylinder head 4 which has a combustion chamber 4*a* leading to the cylinder bore 3*a*, and which is integrally connected to the cylinder block 3; and a head cover 5 bolt-coupled to an end surface of the cylinder head 4. Each of the first and second banks B1 and B2 is integrally molded, and has a large number of cooling fins 6, 6, . . . integrally formed to protrude from an outer surface of the bank.

A single crankshaft 7 is supported by both of front and rear end walls of the crankcase 1. Pistons 8, 8 are fitted respectively into cylinder bores 3*a*, 3*a* of the first and second banks B1 and B2. The pistons 8, 8 are connected to a crankpin 7*p* of the crankshaft 7 via connecting rods 9, 9, respectively. One end wall 1*a* of the front and rear end walls of the crankcase 1 is detachably attached to a main body side of the crankcase 1 while being capable of supporting a corresponding end portion of the crankshaft 7.

As shown in FIG. 1, the first and second banks B1 and B2 are arranged in such a manner that the opening angle α between the banks B1 and B2, that is, the angle α formed by a cylinder center line A1 of the first bank B1 and a cylinder center line A2 of the second bank B2 becomes 90°. In addition, counterweights 7*w* are attached to the crankshaft 7 on a side opposite to the crankpin 7*p*. The counterweights 7*w* balance the inertia forces of the pistons 8 of the respective banks B1 and B2.

Moreover, the first and second banks B1 and B2 are arranged in such a manner that each of the cylinder center line A1 of the first bank B1 and the cylinder center line A2 of the second bank B2 passes a point P eccentric with respect to a rotational center A3 of the crankshaft 7 to the side opposite to both of the banks B1 and B2. This arrangement makes it possible to widen a valley portion 11 defined between the first and second banks B1 and B2 while maintaining the opening angle α between the banks B1 and B2 at 90°. This valley portion 11 houses the entirety of a carburetor C, which is one auxiliary machine of the V-type engine E, and part of an air cleaner Ac having a cleaner element 10 installed therein.

Figure 6:
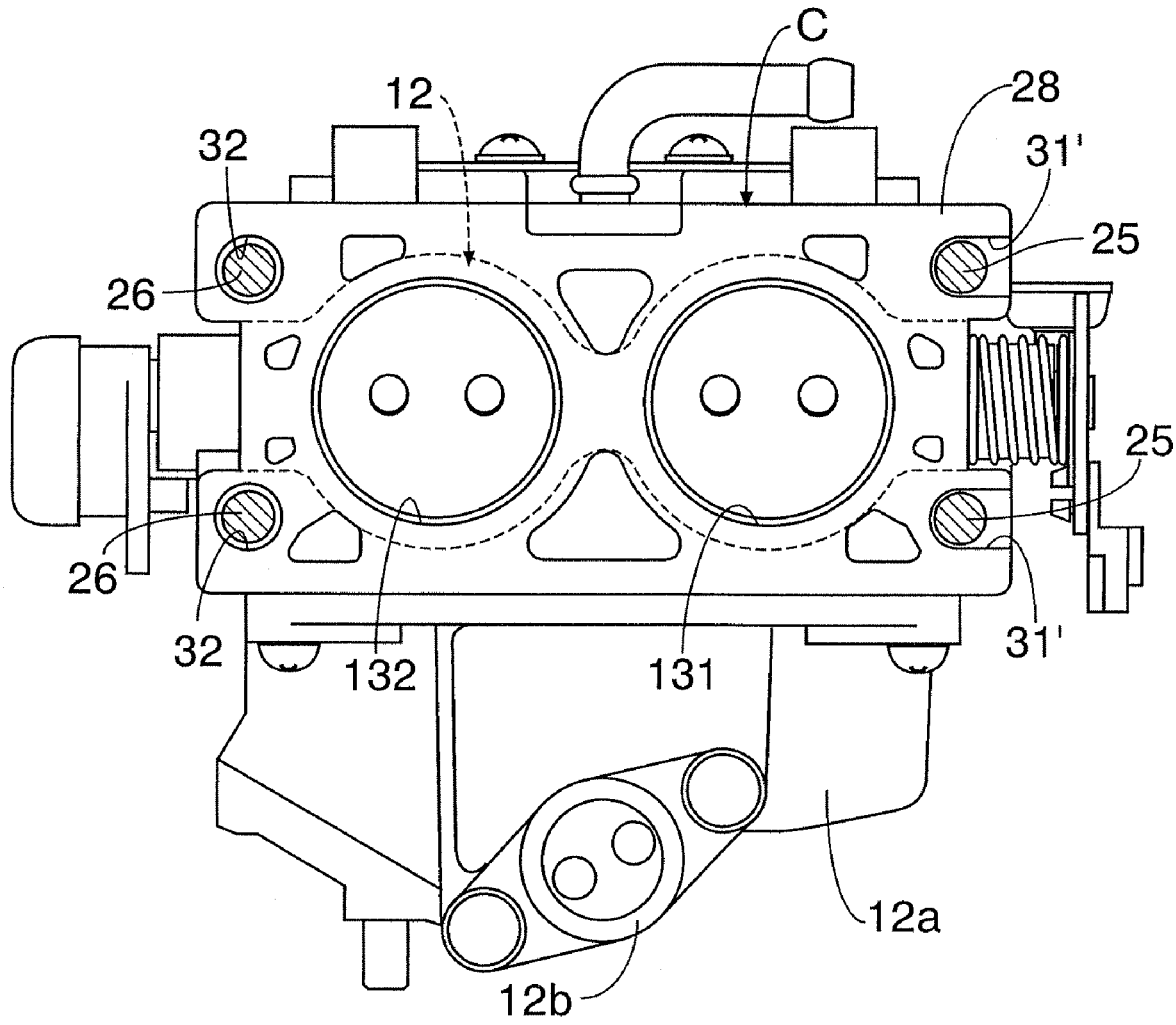
FIG. 6 is a sectional view taken along the line 6-6 in FIG. 4.

As is clear from FIG. 6, the carburetor C is a twin carburetor including: a carburetor main body 12; and first and second intake paths 131, 132 extending in a horizontal direction (a direction orthogonal to the crankshaft 7), and being arranged adjacent to each other in the carburetor main body 12 along with the arrangement direction of the first and second banks B1 and B2. A float chamber 12*a* and a fuel-cutting electromagnetic valve 12*b* are attached to a lower portion of the carburetor main body 12.

Figure 4:
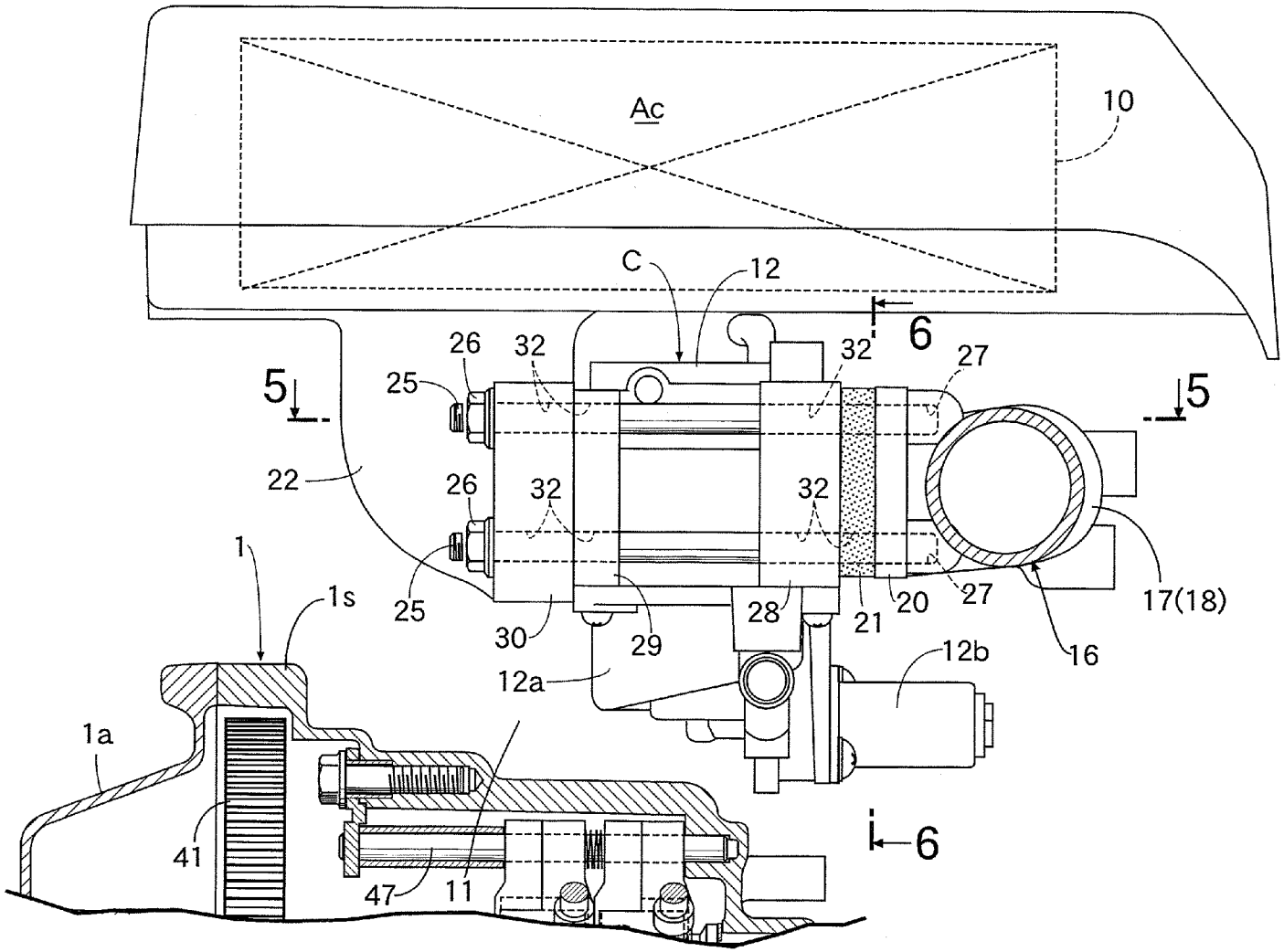
FIG. 4 is a sectional view taken along the line 4-4 in FIG. 1.
Figure 5:
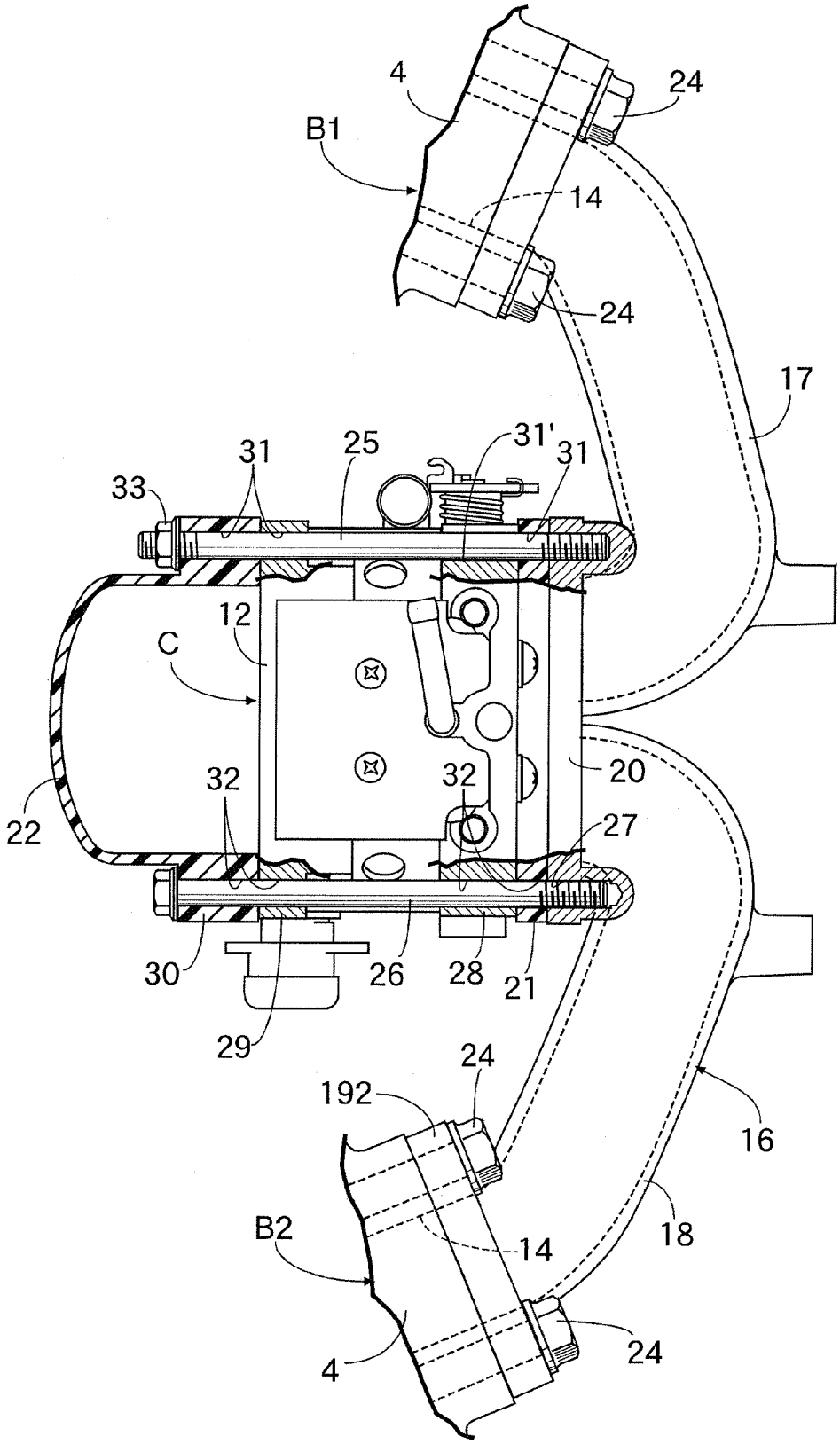
FIG. 5 is a sectional view taken along the line 5-5 in FIG. 4.

As shown in FIGS. 1, 4, and 5, each of the cylinder heads 4, 4 of the first and second banks B1 and B2 includes, in addition to the combustion chamber 4*a*, an intake port 14 and an exhaust port 15 each opened to the combustion chamber 4*a*. Opening end portions of the intake and exhaust ports 14, 15 to the combustion chamber 4*a* are formed respectively in an intake valve seat 80 and an exhaust valve seat 81. The intake valve seat 80 is formed to have a larger diameter than that of the exhaust valve seat 81. Moreover, these intake and exhaust valve seats 80, 81 as well as a plug mounting hole 87, into which an ignition plug 23 is screwed, are arranged adjacent to one another so as to surround the center of the combustion chamber 4*a*.

Figure 9:
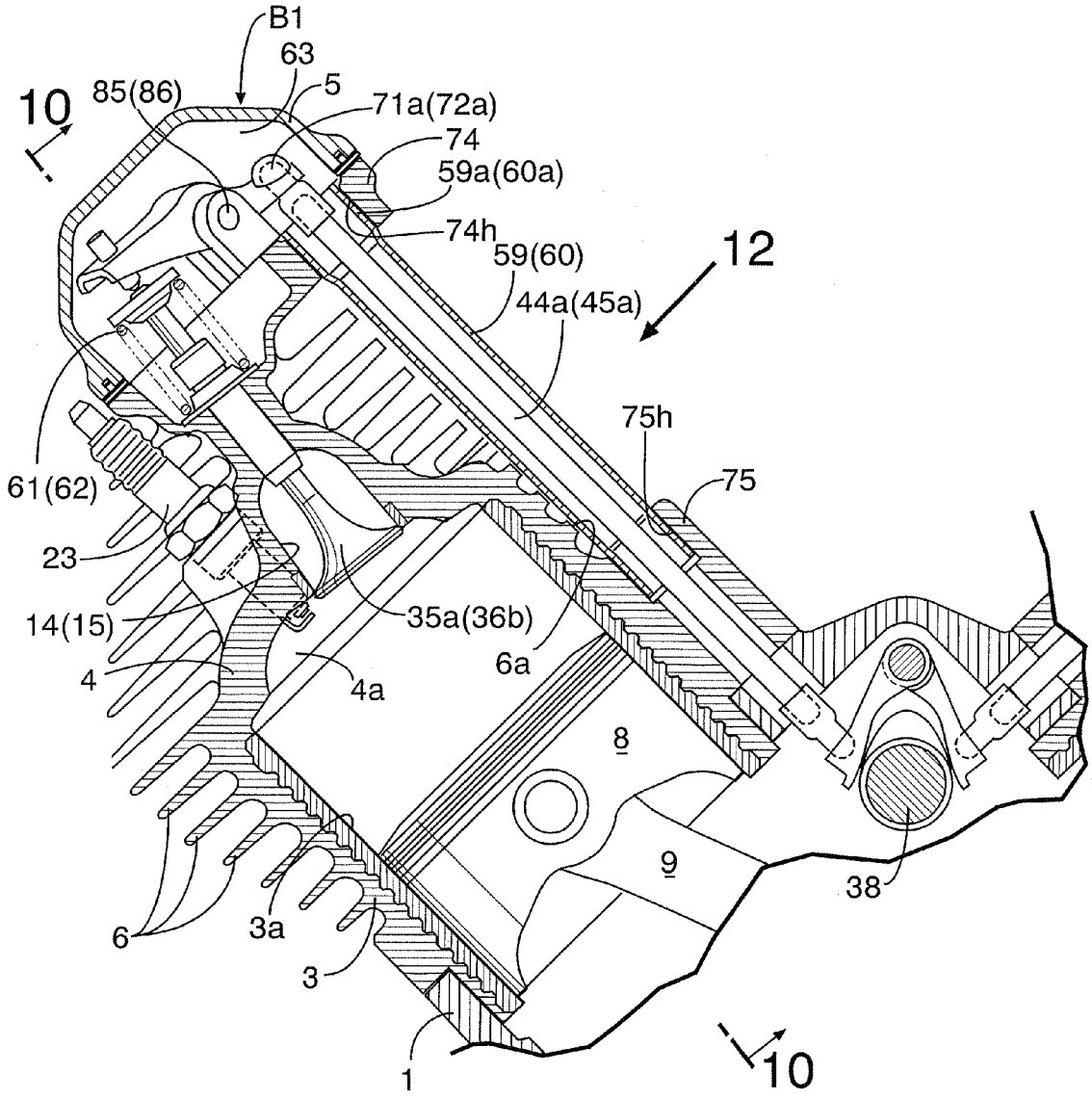
FIG. 9 is an enlarged view of a first bank portion in FIG. 1.
Figure 10:
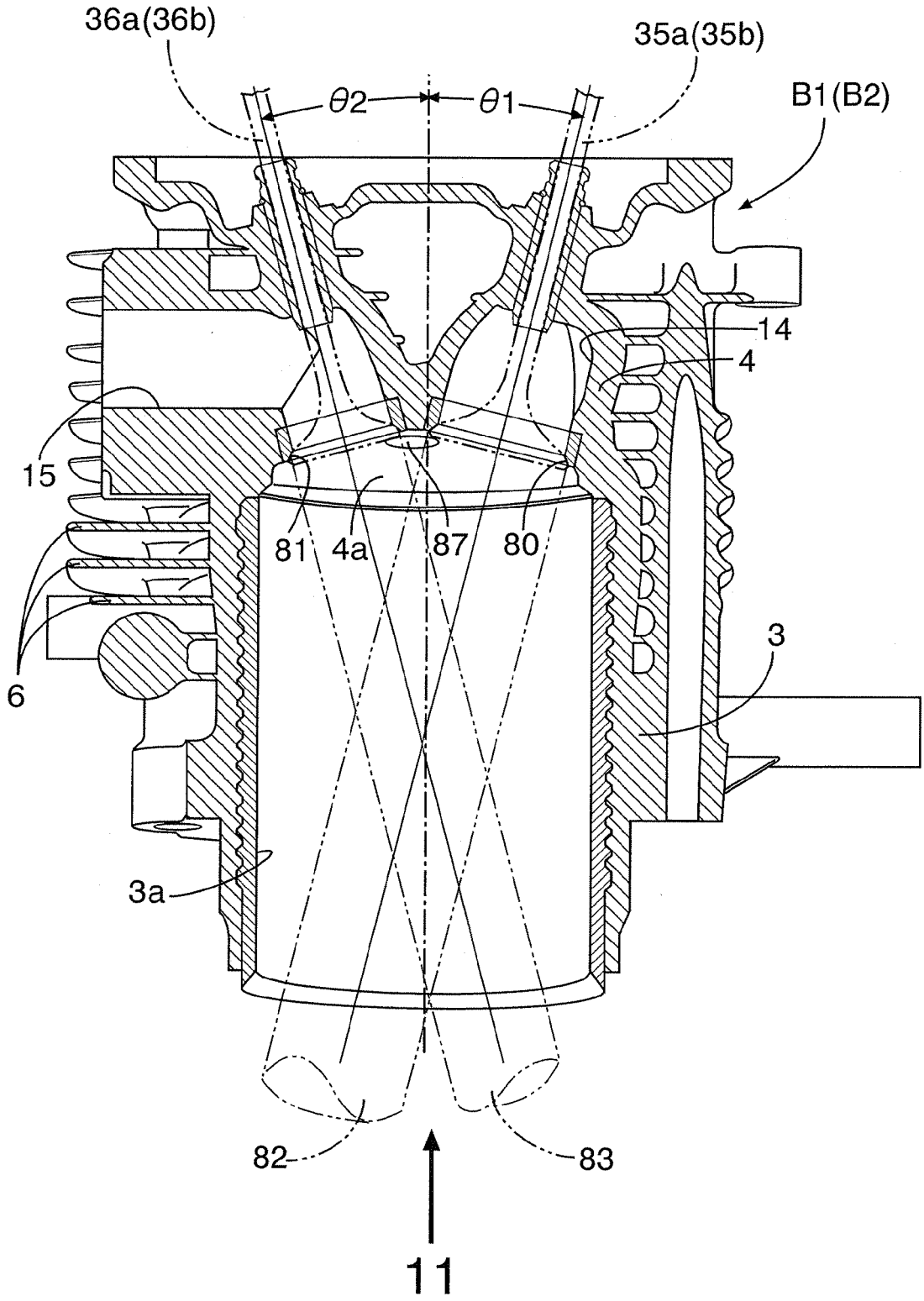
FIG. 10 is a sectional view taken along the line 10-10 in FIG. 9, and showing only the first bank.
Figure 11:
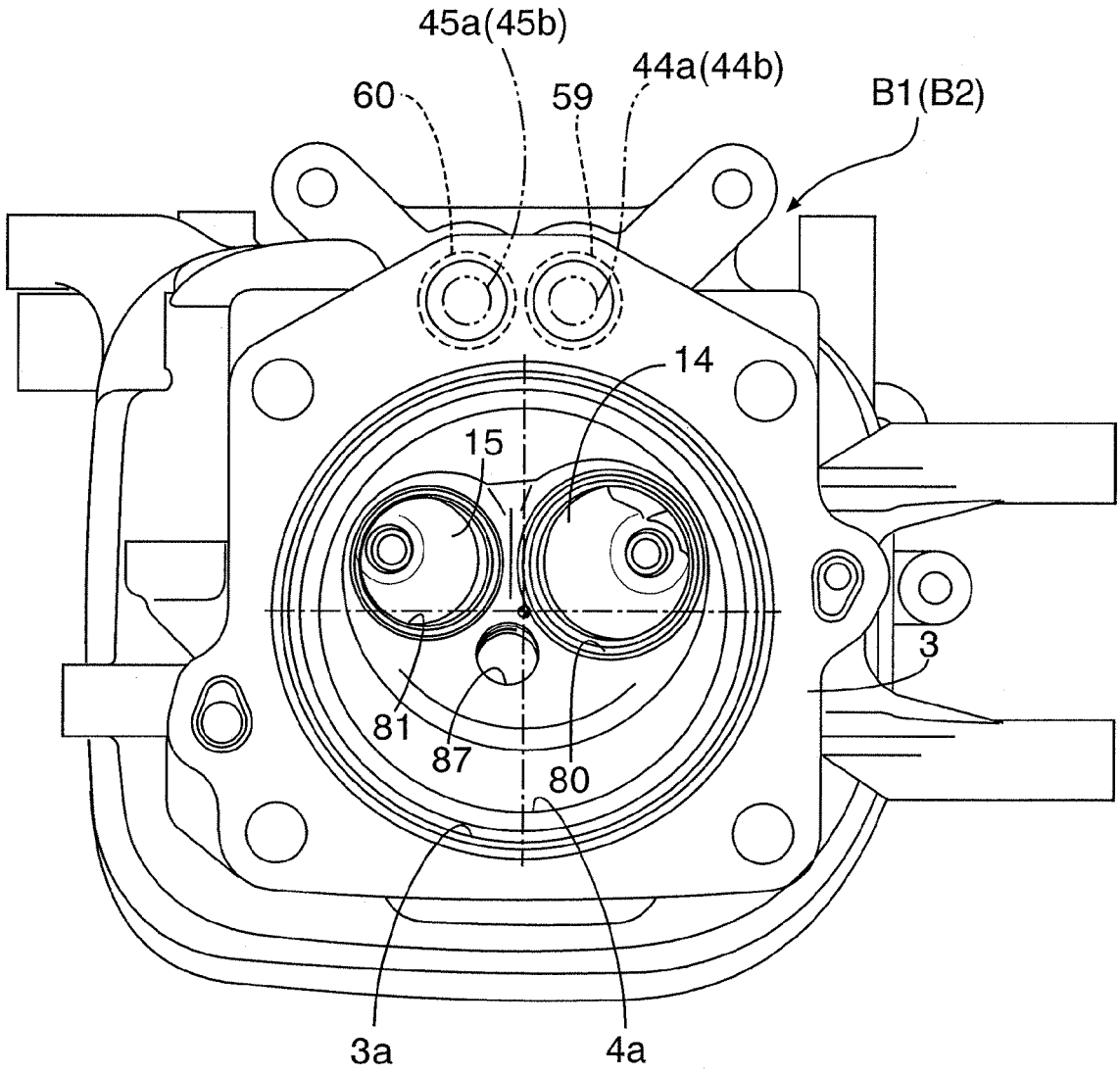
FIG. 11 is a view in the direction of the arrow 11 in FIG. 10.

As shown in FIGS. 9 to 11, an intake valve 35*a*, 35*b*, and an exhaust valve 36*a*, 36*b* are attached to the cylinder head 4 of each of the banks B1 and B2. The intake valve 35*a*, 35*b* opens and closes the corresponding intake port 14 in association with the corresponding intake valve seat 80. The exhaust valve 36*a*, 36*b* opens and closes the corresponding exhaust port 15 in association with the corresponding exhaust valve seat 81. In addition, the ignition plug 23 with an electrode facing to the combustion chamber 4*a* is screwed into the cylinder head 4. Here, each intake valve 35*a*, 35*b* and the corresponding exhaust valve 36*a*, 36*b* are arranged in a V-shape. Valve springs 61, 62 are attached respectively to each intake valve 35 and each exhaust valve 36 so as to urge the valves in the valve closing direction.

Each intake valve 35*a*, 35*b* and the corresponding exhaust valve 36*a*, 36*b* are arranged in a V-shape. In this regard, the inclination angles θ1, θ2 of the axial lines respectively of the intake valve 35*a*, 35*b* and the exhaust valve 36*a*, 36*b* with respect to the center line of the corresponding cylinder bore 3*a* are set, as shown in FIG. 10, in the following manner. Specifically, these inclination angles θ1 and θ2 are set as large as possible within a range allowing cutting process performed on the intake and exhaust valve seats 80, 81 with rotary cutting tools 82, 83 inserted into the cylinder bores 3*a*.

As shown in FIGS. 1, 4, 5, and 6, the first and second intake paths 131, 132 are connected respectively to the intake ports 14, 14 of the first and second banks B1 and B2 with an intake manifold 16.

Specifically, the intake manifold 16 includes first and second conduit paths 17, 18 which are bent, each into a U-shape on the horizontal plane, toward the outer sides of the valley portion 11 so as to cause the intake ports 14, 14 of the first and second banks B1 and B2 to communicate with the first and second intake paths 131, 132, respectively. Individual flanges 191, 192 are formed respectively at the downstream ends of the first and second conduit paths 17, 18. A common flange 20 is formed at the upstream ends of the first and second conduit paths 17, 18 so as to integrally connect these conduit paths 17, 18 to each other. The individual flanges 191, 192 are connected respectively to the cylinder heads 4 and 4 of the first and second banks B1 and B2 with bolts 24, 24. A thermal insulation plate 21, first and second mounting flanges 28, 29, as well as a mounting flange 30 are jointly fastened to the common flange 20 with a plurality of bolts. The first and second mounting flanges 28, 29 are formed respectively at the downstream end and the upstream end of the carburetor C. The mounting flange 30 is formed on the outer periphery of an elbow-shaped air outlet pipe 22 in the air cleaner Ac.

Next, the above-described jointly-fastening structure will be described with reference to FIGS. 4 to 8.

The above-described jointly-fastening structure uses two stud bolts 25, 25 and two tap bolts 26, 26. The two stud bolts 25, 25 are implanted respectively in upper and lower position on one side portion of the common flange 20 of the intake manifold 16. A pair of upper and lower screw holes 27, 27 are provided in the other side portion of the common flange 20.

The two tap bolts 26, 26 are screwed into the upper and lower screw holes 27, 27. In addition, first bolt holes 31, 31, 31', 31 through which the two stud bolts 25, 25 pass, as well as second bolt holes 32, 32 are provided in the first and second mounting flanges 28, 29 of the thermal insulation plate 21 and the carburetor C as well as the mounting flange 30 of the air cleaner Ac. Particularly, each of the first bolt holes 31', 31' of the first mounting flange 28 of the carburetor C is formed into a notch shape which opens to the outer side of the flange 28.

Note that, gaskets may be interposed in front and rear of the thermal insulation plate 21 if necessary.

As shown in FIGS. 1 to 3, 9, 14 and 15, a valve-operating device 37 for opening and closing the intake valves 35*a*, 35*b* as well as the exhaust valves 36*a*, 36*b* of the first and second banks B1 and B2 is provided in a region extending from the crankcase 1 to the cylinder heads 4 of the respective banks B1 and B2. The valve-operating device 37 includes a camshaft 38 and a timing transmission device 39 (see FIG. 2). The camshaft 38 is supported directly above, and in parallel with, the crankshaft 7, by both of the front and rear end walls of the crankcase 1. The timing transmission device 39 reduces the rotational speed of the crankshaft 7 by one half so as to transmit the reduced rotational speed to the camshaft 38. The timing transmission 39 includes: a driving timing gear 40 which is fixed to the crankshaft 7 at a position adjacent to the inner surface of the attachable/detachable end wall 1*a* of the crankcase 1; and a driven timing gear 41 which is secured to the camshaft 38 and which meshes with the driving timing gear 40.

Figure 14:
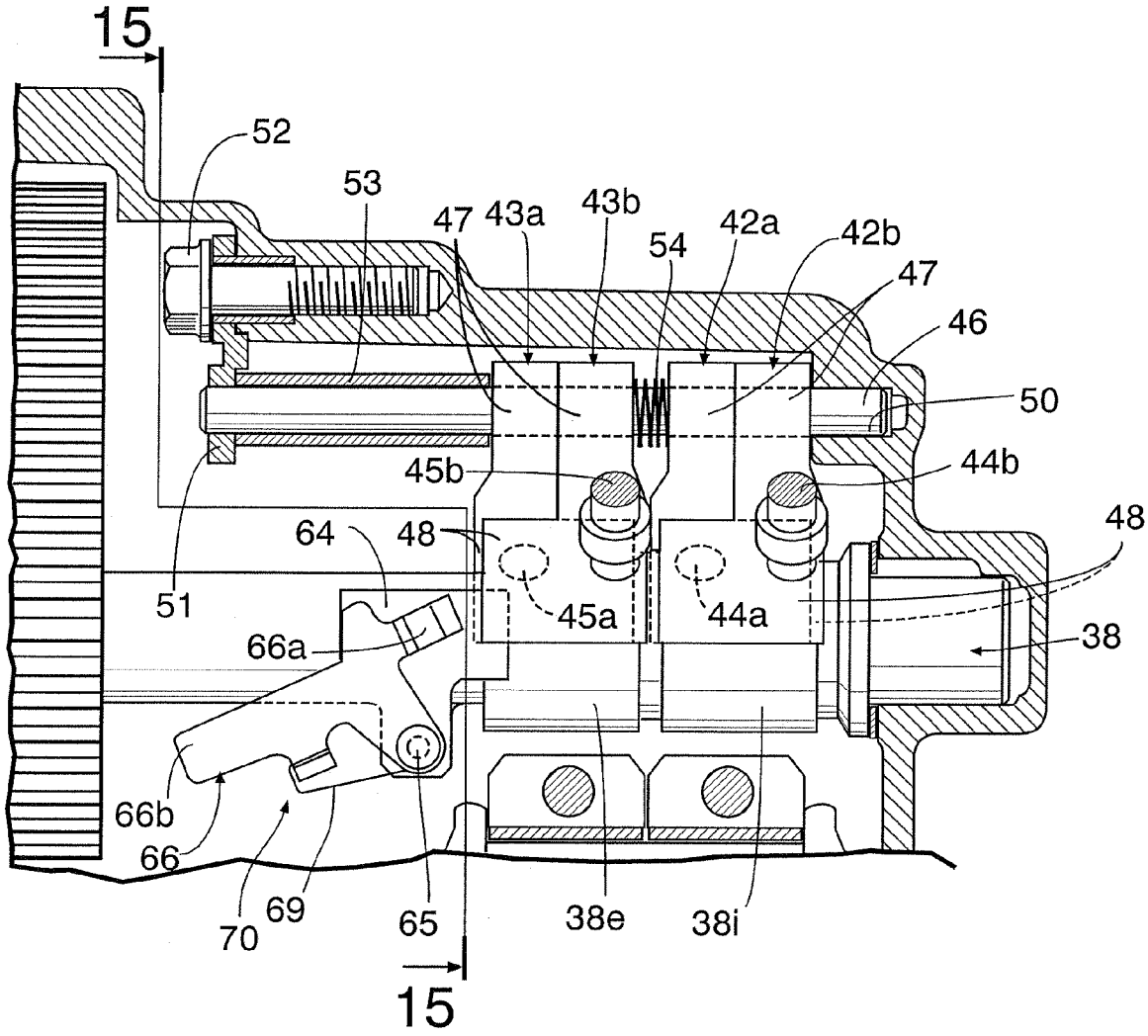
FIG. 14 is an enlarged view of a part indicated by the arrow 14 in FIG. 2.
Figure 15:
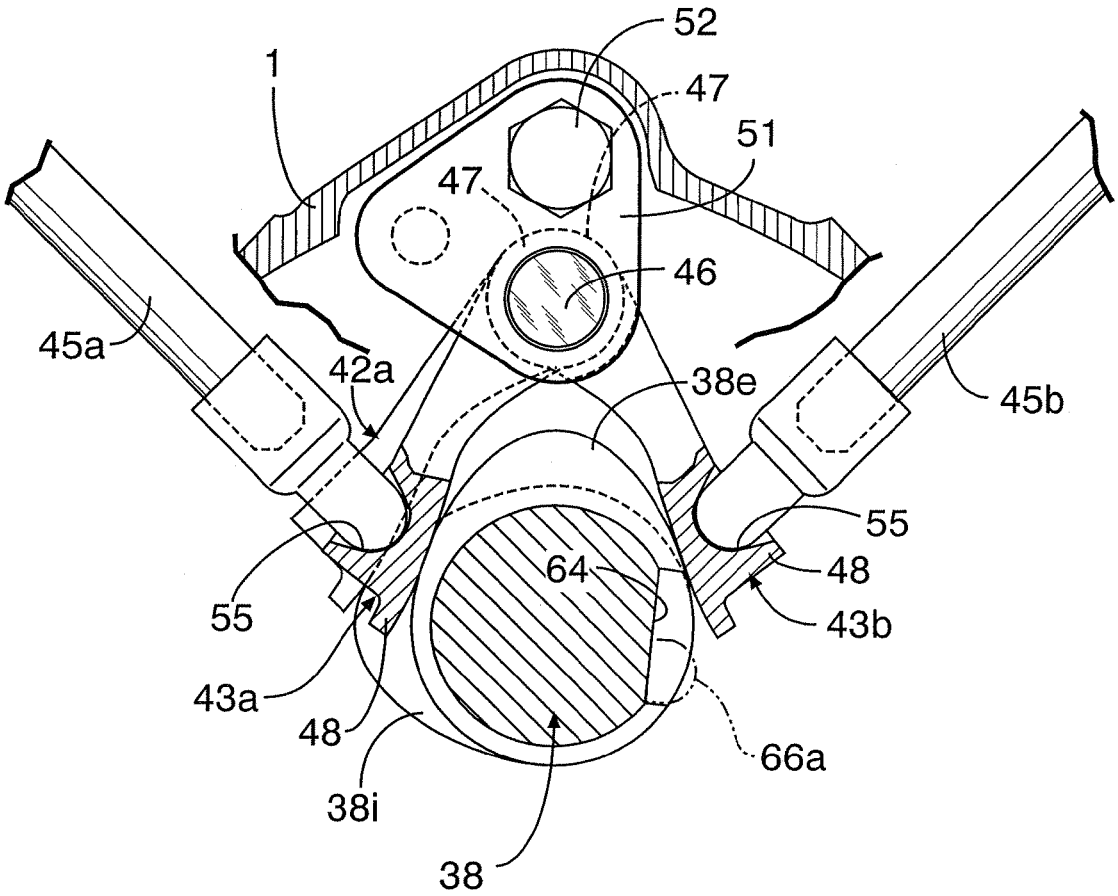
FIG. 15 is a sectional view taken along the line 15-15 in FIG. 14.

An intake cam 38*i* and an exhaust cam 38*e* are integrally formed on the camshaft 38 as shown in FIGS. 14 and 15. The intake cam 38*i* is connected to the intake valves 35*a* and 35*b* of the first and second banks B1 and B2 via first and second intake cam followers 42*a*, 42*b*, first and second intake push rods 44*a*, 44*b*, as well as first and second intake rocker arms 71*a*, 71*b*, respectively (see FIGS. 1 and 3). On the other hand, the exhaust cam 38*e* is connected to the exhaust valves 36*a*, 36*b* of the first and second banks B1 and B2 via first and second exhaust cam followers 43*a*, 43*b*, first and second exhaust push rods 45*a*, 45*b*, as well as first and second exhaust rocker arms 72*a*, 72*b*, respectively. The intake push rod 44*a*, 44*b* and the corresponding exhaust push rod 45*a*, 45*b* are arranged along a side surface, on the valley portion 11 side, of the corresponding one of the banks B1 and B2.

As is clear from FIGS. 14 and 15, each of the first and second intake cam followers 42*a*, 42*b* as well as the first and second exhaust cam followers 43*a*, 43*b* includes a boss portion 47 and a slipper portion 48. The boss portions 47 are swingably supported on a single cam follower shaft 46 which is attached to the crankcase 1, at a position directly above, and in parallel with, the camshaft 38. Each of the slipper portions 48 is in sliding contact with the corresponding one of the cams 38*i*, 38*e*. In the first and second intake cam followers 42*a*, 42*b*, their boss portions 47, 47 abut against each other side by side on the cam follower shaft 46, while their slipper portions 48, 48 have end portions at one end along the axial direction of the camshaft 38 protrude respectively in opposite directions to each other in such a manner that the slipper portions 48, 48 face each other across the intake cam 38*i* located therebetween. Also in the first and second exhaust cam followers 43*a*, 43*b*, their boss portions 47, 47 abut against each other side by side on the cam follower shaft 46, while their slipper portions 48, 48 have end portions at one end along the axial direction of the cam shaft 38 protrude respectively in the opposite directions to each other in such a manner that the slipper portions 48, 48 face each other across the intake cam 38*e* located therebetween.

One end portion of the cam follower shaft 46 is supported by a support hole 50 in the crankcase 1, while the other end portion thereof is supported by a bracket 51 secured to the crankcase 1 with a bolt 52. The cam follower shaft 46 is provided with a distance collar 53 and a coil spring 54. The distance collar 53 abuts against an outer end surface of the boss portion 47 of one of the first and second exhaust cam followers 43*a*, 43*b*. The coil spring 54 is located between the pair of the boss portions 47, 47 of the first and second intake cam followers 42*a*, 42*b* and the pair of boss portions 47, 47 of the first and second exhaust cam followers 43*a*, 43*b*. With the distance collar 53 and the coil spring 54, the first and second intake and exhaust cam followers 42*a*, 43*a*; 42*b*, 43*b* are held adjacent to one another on a predetermined intermediate portion of the cam follower shaft 46. The intake and exhaust cams 38*i*, 38*e* as well as the first and second intake and exhaust cam followers 42*a*, 43*a*; 42*b*, 43*b* are mostly placed within a space D between planes F and F extending respectively from the opposite end surfaces of the crankpin 7*p* of the crankshaft 7.

As shown in FIG. 15, semispherical engaging recesses 55, 55, . . . are formed respectively on rear surfaces of the first and second intake cam followers 42*a*, 42*b* as well as the first and second exhaust cam followers 43*a*, 43*b*. The semispherical lower end portions of the first and second intake push rods 44*a*, 44*b* are engaged respectively with the engaging recesses 55, 55 of the first and second intake cam followers 42*a*, 42*b*. The semispherical lower end portions of the first and second exhaust push rods 45*a*, 45*b* are engaged respectively with the engaging recesses 55, 55 of the first and second exhaust cam followers 43*a*, 43*b*.

As shown in FIG. 3, in the first and second banks B1 and B2, the first and second intake rocker arms 71*a*, 71*b* as well as the first and second exhaust rocker arms 72*a*, 72*b* are swingably supported around an axis in the corresponding cylinder heads 4 with rocker shafts 85, 86. Each pair of the intake and exhaust rocker arms 71*a*, 72*a*; 71*b*, 72*b* are arranged in a substantially inverted-V-shape in a plan view, so that the end portions of the intake and exhaust rocker arms on the side of the corresponding pair of the intake and exhaust push rods 44*a*, 45*a*; 44*b*, 45*b* are positioned adjacent to each other. Accordingly, each pair of the intake and exhaust push rods 44*a*, 45*a*; 44*b*, 45*b* are arranged adjacent to each other.

Tubular rod covers 59, 60 (see FIGS. 1, 9, 11 and 12) which house the corresponding pair of the intake and exhaust push rods 44*a*, 45*a*; 44*b*, 45*b*, arranged adjacent to each other as described above, are attached to each of the banks B1 and B2 in the following manner.

Specifically, upper-portion support portion 74 and lower-portion support portion 75 are integrally formed in each of the banks B1 and B2 so as to protrude respectively from the upper and lower end portions of the bank to the valley portion 11 between the banks B1 and B2. In each of the banks B1 and B2, the upper-portion support portion 74 is provided with an upper-portion mounting holes 74*h*, 74*h* into which the upper end portions of the rod covers 59, 60 are press-fitted, while the lower-portion support portion 75 is provided with a lower-portion mounting hole 75*h*, 75*h* into which the lower end portions of the rod covers 59, 60 are press-fitted. Each upper-portion mounting hole 74*h* and the corresponding lower-portion mounting hole 75*h* are arranged on the same axis, and each upper-portion mounting hole 74*h* is formed to have a larger diameter than that of each lower-portion mounting hole 75*h*. In conjunction with this, each of the upper end portions 59*a* 60*a* of the rod covers 59, 60 is formed to have a larger diameter than the other portion. Accordingly, the rod covers 59, 60 can be easily inserted into the upper-portion mounting holes 74*h*, 74*h* from above, and then can be press-fitted substantially simultaneously into the upper-portion mounting holes 74*h*, 74*h* as well as the lower-portion mounting holes 75*h*, 75*h*.

In each of the banks B1 and B2, the valve springs 61, 62, the intake rocker arms 71*a*, 71*b*, and the exhaust rocker arms 72*a*, 72*b* are housed in a valve-operating chamber 63 defined between the cylinder head 4 and the head cover 5 respectively. Each valve-operating chamber 63 communicates with the inside of the crankcase 1 through a hollow part of each of the rod covers 59, 60.

Figure 12:
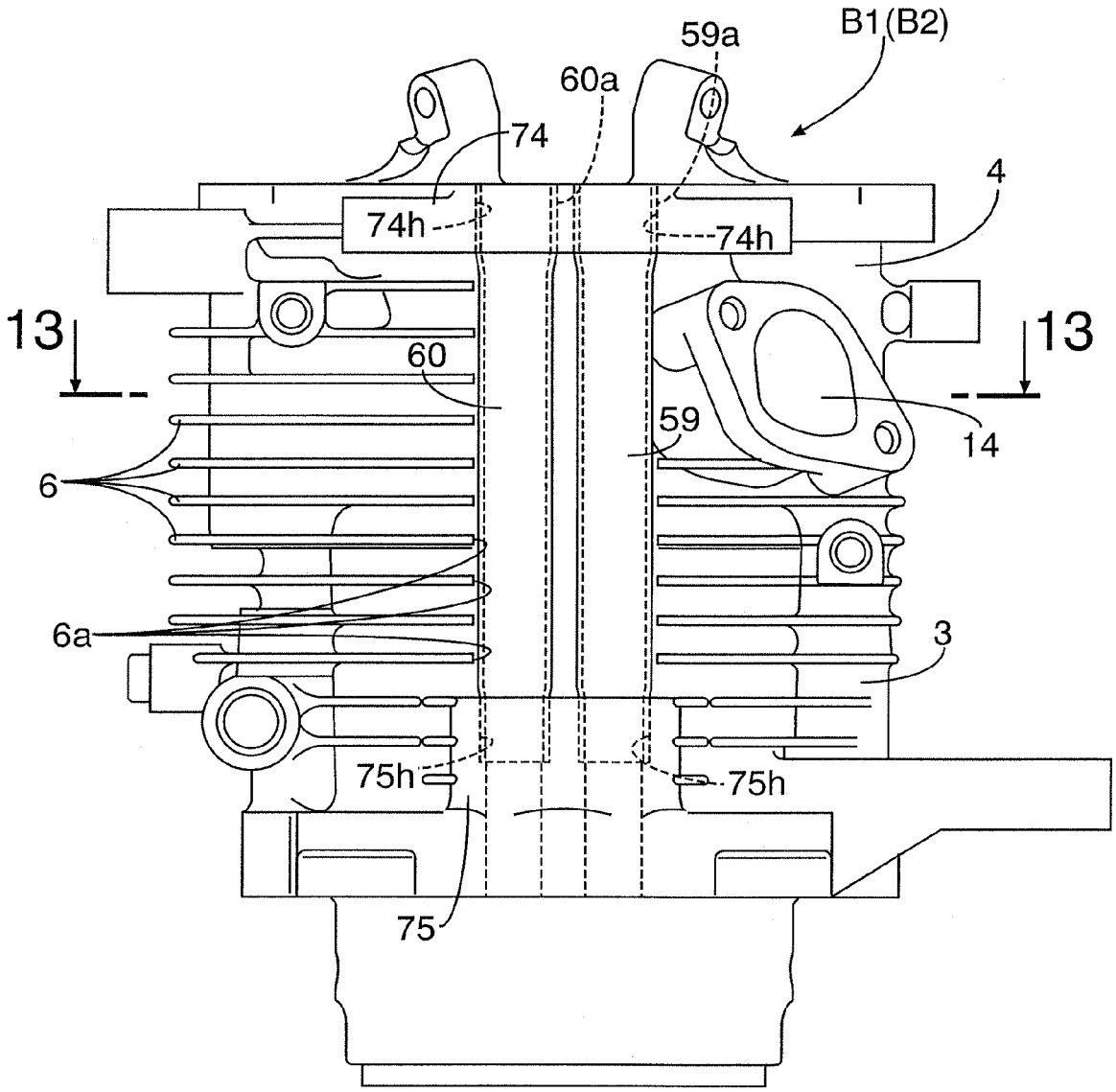
FIG. 12 is a view in the direction of the arrow 12 in FIG. 9.
Figure 13:
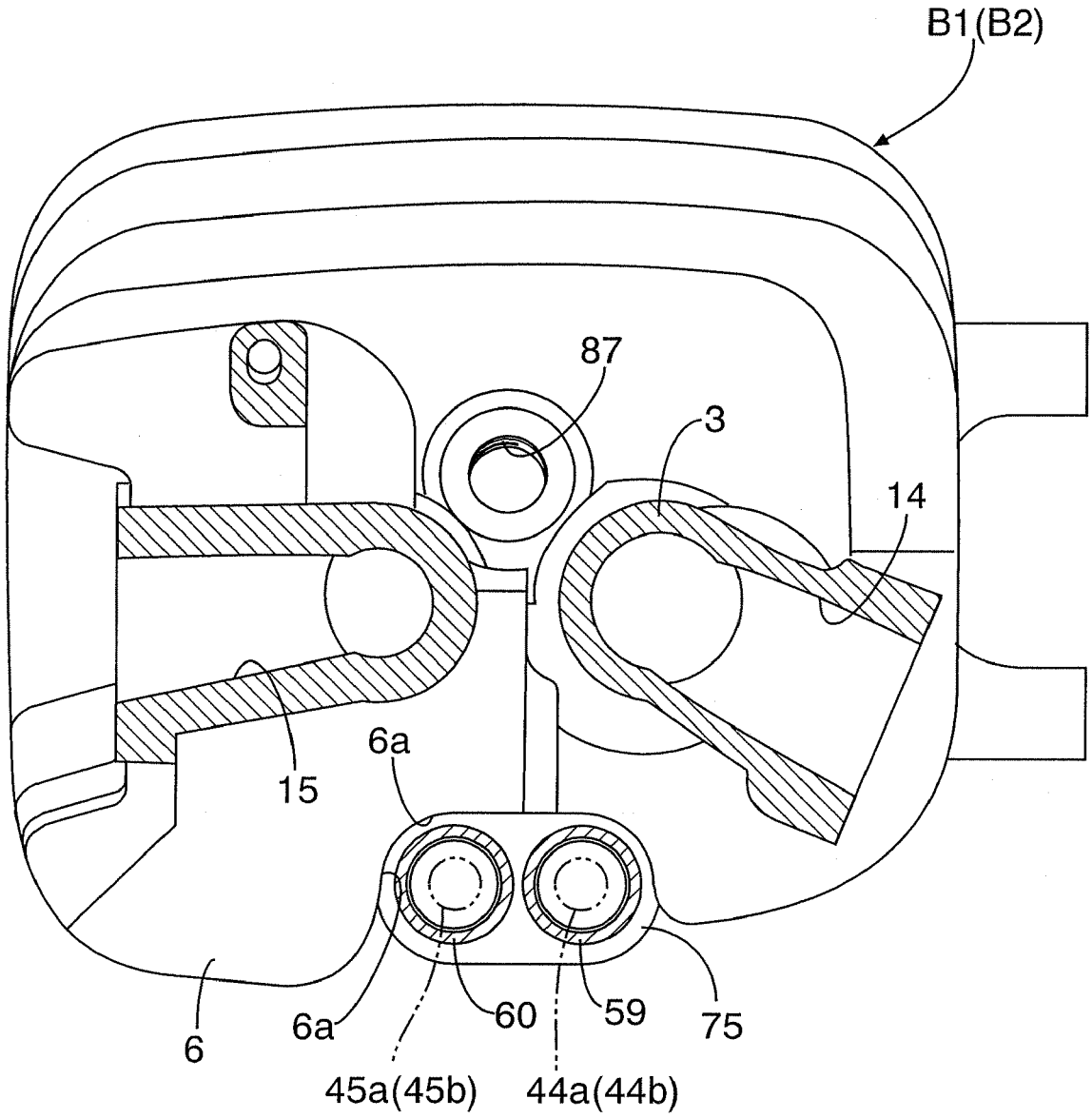
FIG. 13 is a sectional view taken along the line 13-13 in FIG. 12.

Moreover, as shown in FIGS. 9 and 12, the cooling fins 6 are provided with U-shaped notches 6*a* which allow the rod covers 59, 60 to be arranged adjacent to the outer wall of the corresponding one of the banks B1 and B2.

Refer to FIG. 2 again. A flat portion 64 is formed on the camshaft 38 so as to extend from a general surface of the camshaft 38 to a base surface of the exhaust cam 38*e*. A decompressing member 66 is swingably supported on the flat portion 64 with a pivot 65. The decompressing member 66 is made of a steel plate, and includes a decompressing arm 66*a* and a centrifugal weight 66*b*. The decompressing arm 66*a* is located to the base surface side of the exhaust cam 38*e* so as to protrude its tip end from the base surface when the V-type engine E is stopped or started. The centrifugal weight 66*b* generates a centrifugal force for retreating the decompressing arm 66*a* from the base surface of the exhaust cam 38 when the V-type engine E is operated at a rotational speed higher than that during the idling of the V-type engine E. A return spring 69 for urging the decompressing arm 66*a* towards the base surface side of the exhaust cam 38 is connected to the decompressing member 66. A decompressing device 70 is thus comprised of these above-described components.

At the time of start of the V-type engine E, the decompressing arm 66*a* occupies a position at which its tip end protrudes from the base surface of the exhaust cam 38*e* (see the chain line in FIG. 15). Accordingly, even in the compression stroke, the first and second exhaust cam followers 43*a*, 43*b* are very slightly lifted by the decompression arm 66*a* so as to slightly open the exhaust valves 36*a*, 36*b* of the first and second banks B1 and B2. The compression pressure in the cylinder bores 3*a*, 3*a* is thereby lowered, so that the starting load is alleviated. After the start of the V-type engine E, when the camshaft 38 is rotated at a predetermined rotational speed or more, the centrifugal weight 66*b* swings outward in the radial direction against the set load of the return spring 69 due to the centrifugal force acting on the centrifugal weight 66*b*. As a result, the decompressing arm 66*a* is retreated from the base surface of the exhaust cam 38*e*.

In the above-described configuration, all the intake and exhaust push rods 44*a*, 45*a*; 44*b*, 45*b* are interchangeable, so that the same push rod may be used for these. In addition, all the intake and exhaust cam followers 42*a*, 43*a*; 42*b*, 43*b* are also interchangeable, so that the same cam follower may be used for these. Moreover, the rod covers 59, 60 are also interchangeable, so that the same rod cover may be used for these. In this way, the mass productivity of components is enhanced.

Next, the operation of the embodiment will be described.

As described above, the first and second banks B1 and B2 are arranged in such a manner that the opening angle α between the banks B1 and B2 becomes 9020 . Meanwhile, the counterweights 7*w*, which balance the inertia forces of the pistons 8 of the respective banks B1 and B2, are attached to the crankshaft 7 on the side opposite to the crankpin 7*p*. Accordingly, as is well known, the inertia force at the top dead center and the bottom dead center of the piston 8 in each of the banks B1 and B2 balances the centrifugal force of the counterweights 7*w*. Therefore, it is possible to balance the primary inertia force of the V-type engine E without providing a special primary balancer mechanism.

Moreover, the first and second banks B1 and B2 are arranged in such a manner that each of the cylinder center line A1 of the first bank B1 and the cylinder center line A2 of the second bank B2 are arranged to pass the point P eccentric from with respect to the rotational center A3 of the crankshaft 7 to the side opposite to both of the banks B1 and B2. This arrangement allows the valley portion 11 defined between the first and second banks B1 and B2 to be widened with the opening angle α between the banks B1 and B2 being maintained at 90°. Accordingly, since the entire carburetor C, which is one auxiliary machine of the V-type engine E, and a part of the air cleaner Ac can be housed with a margin in the valley portion 11, a compact V-type engine E having a small overall height can be provided.

In addition, in this structure, the carburetor C is the twin carburetor including the first and second intake paths 131 and 132 extending in the horizontal direction (the direction orthogonal to the crankshaft 7), and being arranged along with the arrangement direction of the first and second banks B1 and B2. Moreover, the carburetor C is connected individually to the intake ports 14, 14 of the first and second banks B1 and B2 via the pair of conduit paths 17, 18. This structure makes it possible to avoid the intake interference between the banks B1 and B2 while minimizing the intake resistance, and thereby to improve the output performance of the V-type engine E.

Moreover, the pair of conduit paths 17, 18 comprise the intake manifold 16 along with the common flange 20 formed at the upstream ends of the conduit paths 17, 18 so as to integrally connect these conduit paths 17, 18 to each other. Connecting the common flange 20 to the downstream end of the twin carburetor C simplifies the structure of the intake system of the V-type engine E. As a result, a favorable assemblability of the intake system is achieved.

Figure 7A:
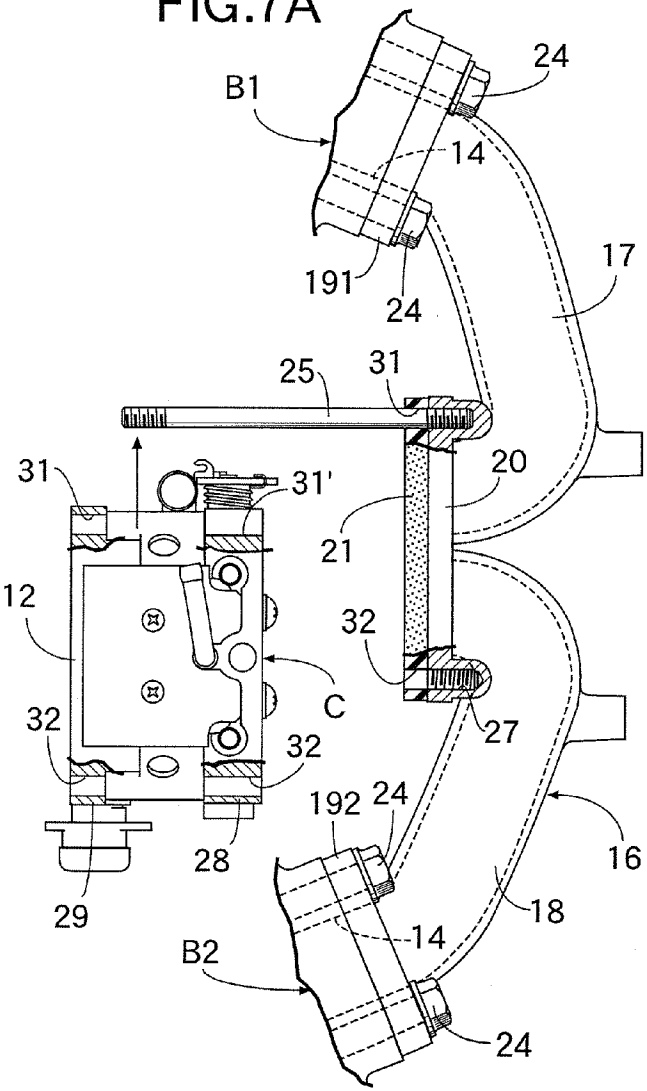
FIG. 7 is a view for explaining a procedure of mounting a carburetor.
Figure 7B:
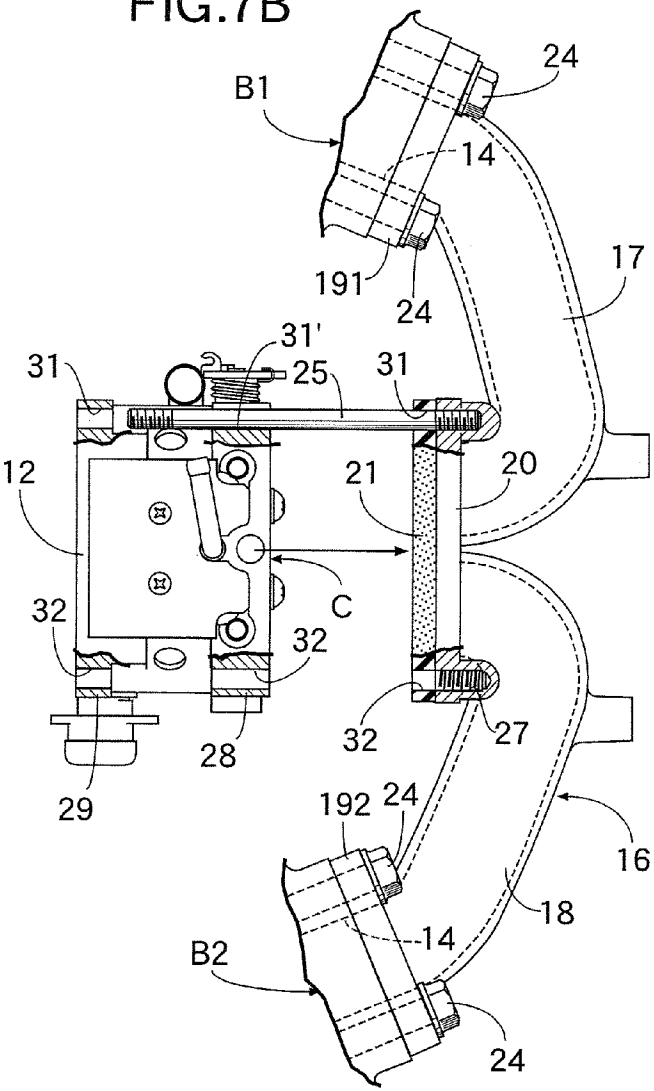

The thermal insulation plate 21, the carburetor C, and the air cleaner Ac are mounted to the common flange 20 of the intake manifold 16 in the following manner. Firstly, as shown in FIG. 7A, the first bolt holes 31, 31 of the thermal insulation plate 21 are fitted respectively onto the two stud bolts 25, 25 which stand, on the upper and lower sides, on the common flange 20. Subsequently, the notched first bolt holes 31', 31' of the first mounting flange 28 of the carburetor C are engaged with the stud bolts 25, 25 from their sides (see FIG. 7A). Thereafter, while the entire carburetor C is moved toward the thermal insulation plate 21, the first bolt holes 31, 31 of the second mounting flange 29 are fitted onto the stud bolts 25, 25 (see FIG. 8). In this way, the carburetor C having a relatively large length in the axial direction can be set at a predetermined fitting position with respect to the stud bolts 25, 25 with a moving amount smaller than the length of the axial direction of the carburetor C. Accordingly, the setting can be quickly performed. In addition, even if a space large enough to house the entire carburetor C does not exist outward of the outer end portions of the stud bolts 25, 25, the carburetor C can be fixed temporality to its fixed position. In this embodiment, as shown in FIG. 4, a bulged portion is of the crankcase 1 exists outward of the outer end portions of the stud bolts 25, 25 due to the existence of the driven timing gear 41 having a large diameter. The bulged portion is interferes with the reception of the float chamber 12*a* and the fuel-cutting electromagnetic valve 12*b* of the carburetor C to a space outward of the outer end portions of the stud bolts 25, 25. In this respect, the structure allowing the carburetor C to be temporarily fixed to its fixed position without interference of the bulged portion 1*s* is very effective.

Figure 8:
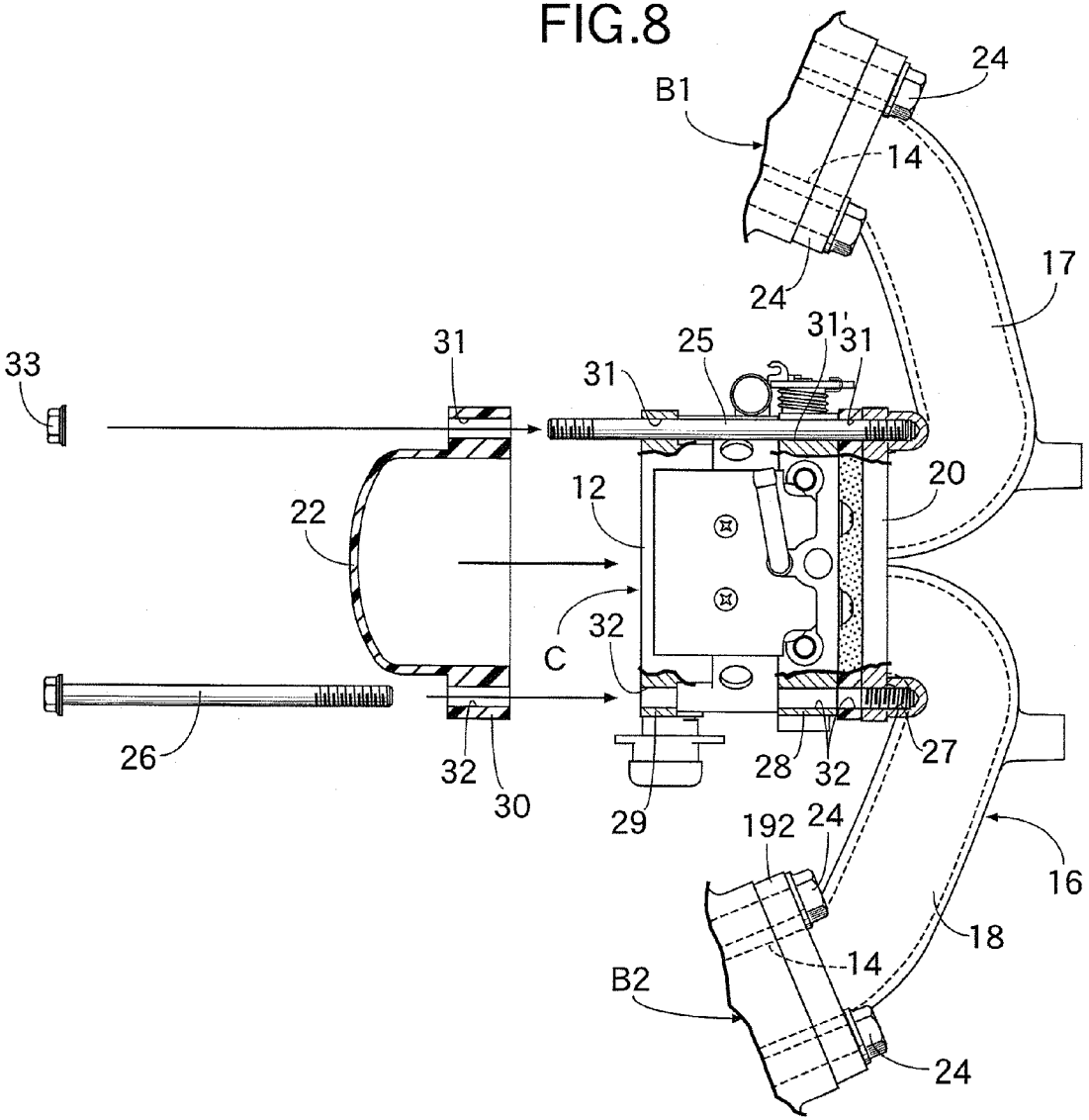
FIG. 8 is a view for explaining a procedure of mounting an air cleaner.

Next, as shown in FIG. 8, the first bolt holes 31, 31 of the mounting flange 30 of the air cleaner Ac are fitted respectively onto the stud bolts 25, 25. After that, while nuts 33, 33 are finally screwed and fastened respectively to the outer end portions of the stud bolts 25, 25, the tap bolts 26, 26 are inserted into all the second bolt holes 32, 32, and are thus screwed and fastened into the screw holes 27, 27 of the common flange 20. When the tap bolt 26 is inserted into the second bolt hole 32, the tap bolt 26 needs to be moved by a distance larger than the total length of the carburetor C. However, since each tap bolt 26 is thin, the space for moving the tap bolt 26 can be easily secured in general.

In the above-described structure, using of the two stud bolts 25, 25 provides the following effects. Specifically, the two first bolt holes 31, 31 of each of the thermal insulation plate 21, the carburetor C, and the air cleaner Ac are fitted onto the stud bolts 25, 25. This makes it possible to obtain a reliable temporary fixed state where the rotation of the thermal insulation plate 21, the carburetor C, and the air cleaner Ac around any one of the stud bolts 25, 25 is inhibited. Accordingly, the subsequent operations, of inserting the tap bolts 26, 26 into the second bolt holes 32, 32, as well as of screwing the tap bolts 26, 26 into the screw holes 27, 27 are facilitated.

In addition, by use of the tap bolts 26, 26 in combination, the carburetor C can be properly fixed to its fixed position without interference of the existence of the notched first bolt holes 31', 31'. Moreover, since the first and second mounting flanges 28, 29, which are formed respectively at the downstream and upstream ends of the carburetor C, are fastened to the common flange 20 with the stud bolts 25, 25 as well as the tap bolts 26, 26, the mounting strength of the carburetor C is enhanced.

The carburetor C and the air cleaner Ac can be dismounted from the common flange 20 by conversely performing the above-described operation procedures.

The valve-operating device 37 has the following structure. Each pair of the intake and exhaust rocker arms 71*a*, 72*a*; 71*b*, 72*b* of each bank B1, B2 are arranged in the substantially inverted-V-shape in the plan view, so that the end portions of the intake and exhaust rocker arms on the side of the corresponding pair of the intake and exhaust push rods 44*a*, 45*a*; 44*b*, 45*b* are positioned adjacent to each other. Accordingly, each pair of the intake and exhaust push rods 44*a*, 45*a*; 44*b*, 45*b* are arranged adjacent to each other. While these intake and exhaust push rods 44*a*, 45*a*; 44*b*, 45*b* are housed in the tubular rod covers 59, 60, the upper and lower ends of each pair of the rod covers 59, 60 are supported by the upper-portion support portion 74 and the lower-portion support portion 75 protruding toward the valley portion 11 respectively from the upper and lower end portions of the corresponding one of the banks B1 and B2. In addition, the cooling fins 6 of each of the banks B1 and B2 are provided with the notches 6*a* which allow the rod covers 59, 60 to be arranged adjacent to the outer wall of the corresponding one of the banks B1 and B2. With this structure, most parts of the intake and exhaust push rods 44*a*, 45*a*; 44*b*, 45*b* can be disposed outside the banks B1 and B2. Accordingly, this structure makes it possible to eliminate the need to form a rod chamber in each of the banks B1 and B2, and also to downsize the banks B1 and B2 by reducing dead materials, thereby achieving weight reduction. Furthermore, since there is no rod chamber, the outer wall of the cylinder bore 3*a* in each of the banks B1 and B2 can be exposed to the outside in a wider area. As a result, the air-cooling effect can be improved.

Each pair of the intake and exhaust push rods 44*a*, 45*a*; 44*b*, 45*b*, which are disposed outside the banks B1 and B2, are housed in, and protected by, the corresponding rod covers 59, 60, which are supported by the upper-portion and lower-portion support portions 74, 75 protruding toward the valley portion 11 respectively from the upper and lower end portions of the corresponding one of the banks B1 and B2. Moreover, since the rod covers 59, 60 are disposed, on the valley portion 11 side, between the first and second banks B1 and B2, the rod covers 59, 60 are protected by the banks B1 and B2 from being brought into contact with foreign objects.

In each of the banks B1 and B2, the corresponding pair of the intake and exhaust rocker arms 71*a*, 72*a*; 71*b*, 72*b* are arranged in the substantially inverted-V-shape in the plan view, so that the end portions of the intake and exhaust rocker arms on the side of the corresponding pair of the intake and exhaust push rods 44*a*, 45*a*; 44*b*, 45*b* are positioned adjacent to each other. Accordingly, each pair of the intake and exhaust push rods 44*a*, 45*a*; 44*b*, 45*b* are arranged adjacent to each other. In addition, the cooling fins 6 of each of the banks B1 and B2 are provided with the notches 6*a* which allow the rod covers 59, 60, which house each pair of the intake and exhaust push rods 44*a*, 45*a*; 44*b*, 45*b*, to be arranged adjacent to the outer wall of the corresponding one of the banks B1 and B2. Accordingly, it is possible to minimize the width of each notch 6*a*, and thereby to keep, at the minimum level, a reduction in heat radiating function of the cooling fins 6 due to the notches.

In addition, each of the cam followers 42*a*, 43*a*; 42*b*, 43*b* includes the boss portion 47 and the slipper portion 48. Each boss portion 47 is swingably supported on the single cam follower shaft 46, which is attached to the crankcase 1, at a position directly above, and in parallel with, the camshaft 38. Each slipper portion 48 is in sliding contact with the corresponding one of the cams 38*i*, 38*e*. In the first and second intake cam followers 42*a*, 42*b*, their boss portions 47, 47 abut against each other side by side on the cam follower shaft 46, while their slipper portions 48, 48 have end portions at one end along the axial direction of the camshaft 38 protrude respectively in opposite directions to each other in such a manner that the slipper portions 48, 48 face each other across the intake cam 38*i* located therebetween. In addition, in the first and second exhaust cam followers 43*a*, 43*b*, their boss portions 47, 47 abut against each other side by side on the cam follower shaft 46, while their slipper portions 48, 48 have end portions at one end along the axial direction of the camshaft 38 protrude respectively in opposite directions to each other in such a manner that the slipper portions 48, 48 face each other across the exhaust cam 38*e* located therebetween. Accordingly, the first intake and exhaust cam followers 42*a*, 43*a* as well as the second intake and exhaust cam followers 42*b*, 43*b* can be concentratedly arranged on the single camshaft 38 and the single cam follower shaft 46. This concentrated arrangement makes it possible to achieve the compact valve-operating device 37, and in particular, to shorten the camshaft 38. Furthermore, the following effect is provided by the structure in which, in each of the pair of the first and second intake cam followers 42*a*, 42*b* as well as the pair of the first and second exhaust cam followers 43*a*, 43*b*, the slipper portions 48, 48; 48, 48, which are positioned respectively on the opposite sides of the corresponding cam 38*i*, 38*e*, have the portions at one end along the axial direction of the camshaft 38 protrude respectively in opposite directions to each other in such a manner that the slipper portions 48, 48; 48, 48 face each other across. Specifically, the sliding area of each of the slipper portions 48, 48; 48, 48 with the corresponding cam 38*i*, 38*e* can be sufficiently secured. As a result, this structure sufficiently reduces the surface pressure of each sliding contact portion, and thus can contribute to an improvement in the wear resistance of these components.

In addition, the first and second intake and exhaust cam followers 42*a*, 43*a*; 42*b*, 43*b* for the banks B1 and B2, as well as the intake and exhaust cams 38*i*, 38*e* are mostly placed within the space D between the planes F and F extending respectively from the opposite end surfaces of the crankpin 7*p* of the crankshaft 7, achieving the compact valve operating-device 37. Accordingly, while the crankshaft 7 is rotated, the periphery of the intake and exhaust cams 38*i*, 38*e* can be effectively lubricated with lubricating oil dispersed from around the crankpin 7*p*.

Moreover, the flat portion 64 is formed on the camshaft 38 so as to extend from the general surface of the camshaft 38 to the base surface of the exhaust cam 38*e*. Then, the decompressing member 66 is swingably supported around an axis on the flat portion 64. The decompressing member 66 includes the decompressing arm 66*a* and the centrifugal weight 66*b*. When the V-type engine E is stopped or started, the decompressing arm 66*a* is located to its operating position on the base surface side of the exhaust cam 38*e* and protrudes its tip end from the base surface so as to lift the first and second exhaust cam followers 43*a*, 43*b* in the compression stroke of the V-type engine E. The centrifugal weight 66*b* generates a centrifugal force for retreating the decompressing arm 66*a* from the base surface of the exhaust cam 38*e* when the V-type engine E is operated at a rotational speed higher than that during the idling of the V-type engine E. In addition, the return spring 69 for urging the decompressing arm 66*a* toward the operating position is connected to the decompressing member 66. This structure provides the following effect in association with the aforementioned structure of the first and second exhaust cam followers 43*a*, 43*b* in which their boss portions abut against each other side by side on the cam follower shaft, and in which their slipper portions have end portions at one end along the axial direction of the camshaft 38 protrude respectively in opposite directions to each other in such a manner that the slipper portions face each other across the exhaust cam located therebetween. Specifically, at the operating position of the decompressing member 66, only slight protrusion of the tip end portion of the decompressing arm 66*a* toward the exhaust cam 38*e* makes it possible to provide very slight lift to the first and second exhaust cam followers 43*a*, 43*b* by bringing the tip end portion substantially evenly in sliding contact with the first and second exhaust cam followers 43*a*, 43*b*. In this regard, the smaller length of protrusion of the tip end portion of the decompressing arm 66*a* toward the exhaust cam 38*e* has the following meaning. Specifically, this makes it possible to achieve a compact single decompressing device 70 shared by both the banks B1 and B2, and also to improve the durability of the exhaust cam 38*e* and the exhaust cam followers 43*a*, 43*b* while minimizing a reduction in the effective area of the base surface of the exhaust cam 38*e* due to the formation of the flat portion 64.

Furthermore, the flat portion 64 is formed on the camshaft 38 so as to extend from the general surface of the camshaft 38 to the base surface of the exhaust cam 38*e*. The decompressing arm 66*a* of the decompressing member 66, which is supported around an axis on the flat portion 64, is caused to protrude toward the base surface of the exhaust cam 38*e* when the V-type engine E is stopped or started. This structure eliminates the need to cause the slipper portions 38, 38 of the first and second exhaust cam followers 43*a*, 43*b* to protrude outward of the exhaust cam 38*e*. As a result, it is possible to achieve the decompressing operation performed at the time of start of the V-type engine E while keeping the compactness of the valve-operating device 37.

Although, the embodiment of the present invention has been described so far, various modifications in design may be made on the present invention without departing from the scope of the present invention.

What is claimed is:

1. A V-type engine comprising:

first and second banks each of which includes a cylinder bore therein, and which are arranged in a V-shape so as to define a valley portion therebetween;

a crankcase with which the first and second banks are continuously formed;

a crankshaft supported by the crankcase;

a cooling fin which protrudes on an outer wall of each of the banks;

intake and exhaust valves which are arranged in a V-shape in a head portion of each of the banks; and a valve-operating device which drives the intake and exhaust valves to be opened and closed, the valve-operating device including:

a camshaft being disposed above the crankshaft and driven by the crankshaft, first intake and exhaust cam followers and second intake and exhaust cam followers being moved up and down by intake and exhaust cams of the camshaft, respectively, first intake and exhaust push rods and second intake and exhaust push rods, the first intake and exhaust push rods having lower ends which are operatively connected respectively to the first intake and exhaust cam followers, and being disposed on the valley portion side of the first bank, the second intake and exhaust push rods having lower ends which are operatively connected respectively to the second intake and exhaust cam followers, and being disposed on the valley portion side of the second bank, and first intake and exhaust rocker arms and second intake and exhaust rocker arms, the first intake and exhaust rocker arms operatively connecting upper ends of the first intake and exhaust push rods respectively to the intake and exhaust valves of the first bank, the second intake and exhaust rocker arms operatively connecting upper ends of the second intake and exhaust push rods respectively to the intake and exhaust valves of the second bank, wherein the intake and exhaust rocker arms in each bank are arranged in a substantially inverted-V-shape in a plan view, so that end portions of the intake and exhaust rocker arms on the side of the corresponding intake and exhaust push rods are positioned adjacent to each other, thereby intake and exhaust push rods are positioned adjacent to each other, each of the cam followers is comprised of a boss portion swingably supported on a single cam follower shaft supported by the crankcase at a position directly above and in parallel with the camshaft, and a slipper portion being in sliding contact with a corresponding one of the intake and exhaust cams, the boss portions of the first and second intake cam followers abut against each other side by side on the cam follower shaft, while their slipper portions have end portions at one end along an axial direction of the camshaft protrude respectively in opposite directions to each other in such a manner that the slipper portions face each other across the intake cam located therebetween, the boss portions of the first and second exhaust cam followers abut against each other side by side on the cam follower shaft, while their slipper portions have end portions at one end along the axial direction of the camshaft protrude respectively in opposite directions to each other in such a manner that the slipper portions face each other across the exhaust cam located therebetween, the first and second intake cam followers and the first and second exhaust cam followers are arranged adjacent to one another on an intermediate portion of the cam follower shaft, which is supported, at opposite end portions thereof, by the crankcase, and corresponding to the cam followers, the intake and exhaust cams are arranged adjacent to each other.

2. The V-type engine according to claim 1, wherein the first and second intake and exhaust cam followers of both of the banks as well as the intake and exhaust cams are mostly placed within a space between planes extended respectively from opposite end surfaces of a crankpin of the crankshaft.

3. The V-type engine according to any one of claims 1 and 2 further comprising:

a flat portion formed in the camshaft so as to extend from an outer peripheral face of the camshaft to a base surface of the exhaust cam;

a decompressing member being swingably and pivotally supported on the flat portion, and including a decompressing arm which is located over a period between instants when the V-type engine stops and starts, to its operating position on the base surface side of the exhaust cam and protrudes its tip end from the base surface so as to lift the first and second exhaust cam followers in the compression stroke of the V-type engine, and a centrifugal weight which generates a centrifugal force for retreating the decompressing arm from the base surface when the V-type engine is operated at a rotational speed higher than that during the idling of the V-type engine; and a return spring for urging the decompressing arm toward the operating position, the return spring being connected to the decompressing member.

* * * * *